US006360913B1

(12) United States Patent
Bruinsma et al.

(10) Patent No.: US 6,360,913 B1
(45) Date of Patent: Mar. 26, 2002

(54) CUP HOLDER

(76) Inventors: Dirk Bruinsma, 308 Via Promesa, San Clemente, CA (US) 92673; Bruce H. Hale, #4 Lexington, Irvine, CA (US) 92620

( * ) Notice: Subject to any disclaimer, the term of this patent is extended or adjusted under 35 U.S.C. 154(b) by 0 days.

(21) Appl. No.: 09/817,922

(22) Filed: Mar. 26, 2001

(51) Int. Cl.[7] ..... A47J 45/00
(52) U.S. Cl. ..... 220/737; 220/738; 229/400
(58) Field of Search ..... 220/737, 738; 229/400, 402; 294/31.2

(56) References Cited

U.S. PATENT DOCUMENTS

| | | | | | |
|---|---|---|---|---|---|
| 1,389,594 | A | * | 9/1921 | Moore | 220/738 |
| 2,128,466 | A | * | 8/1938 | Machotka | 294/33 |
| 3,409,207 | A | * | 11/1968 | Eicholtz et al. | 220/738 X |
| 3,481,639 | A | * | 12/1969 | Lawrence | 294/31.2 |
| 3,596,795 | A | * | 8/1971 | D'Ercoli | 220/738 X |
| D222,554 | S | | 11/1971 | Cockrum | |
| D233,317 | S | | 10/1974 | Catelli | |
| 4,552,276 | A | * | 11/1985 | Büch | 220/737 X |
| 4,620,631 | A | | 11/1986 | Bartelt | |
| 4,685,583 | A | | 8/1987 | Noon | |
| 4,715,633 | A | | 12/1987 | Brink et al. | |
| 4,874,109 | A | | 10/1989 | Cook | |
| 4,928,848 | A | | 5/1990 | Ballway | |
| 4,993,675 | A | | 2/1991 | Walker | |
| 5,147,067 | A | | 9/1992 | Effertz | |
| D333,072 | S | | 2/1993 | Hung | |
| D370,384 | S | | 6/1996 | Shamis | |
| D378,335 | S | | 3/1997 | Liebling et al. | |
| 5,613,720 | A | * | 3/1997 | Shaddy | 220/738 X |
| 5,655,805 | A | | 8/1997 | Shaddy, Jr. | |
| D395,205 | S | | 6/1998 | Inwood et al. | |
| 5,775,570 | A | | 7/1998 | Kim | |
| D405,321 | S | | 2/1999 | Martorana | |

* cited by examiner

*Primary Examiner*—Steven Pollard
(74) *Attorney, Agent, or Firm*—Fulwider Patton Lee & Utecht, LLP

(57) ABSTRACT

A cup holder incorporating an expandable circular band to which is affixed a handle having vertically oriented finger rings and a vertically projecting stem that includes a finger pad.

21 Claims, 3 Drawing Sheets

CUP HOLDER

BACKGROUND OF THE INVENTION

1. Field of the Invention

The present invention relates generally to cup holding devices, and more particularly to a cup holder that insulates the user's hand from the cup.

2. Description of the Prior Art

Most disposable drinking cups are not generally outfitted with integral gripping means by which a user may grip the cup. Therefore, the user is most often required to grip the cup directly at several points about its circumference using his or her fingers and hand in order gain favorable purchase of the cup when the user is drinking from it or moving its location. However, because drinking cups, whether they be formed from plastic, paper, or any other material known in the art, are generally smooth on their outer surfaces, they may be easily dropped, particularly when the outside surface is wet from condensation or liquid spillage.

More commonly, such cups are generally poorly insulated and can become very hot to the touch on their outer surfaces when they contain hot beverages such as coffee or tea. As a result, the user is unable to securely and confidently grasp the cup without enduring some degree of pain if the beverage is hot, or without concern that the high temperature or the condensation or spillage that may be present on the outside of the cup will interfere with the grip and cause the cup to slip from his or her hand.

There have been several advancements in the art that have sought to address these concerns. Some have proposed handles in the form of strips that surround the cup, or other beverage container, that are connected by elements built into the strip itself For example, U.S. Pat. No. 4,685,583 issued to Noon discloses a disposable handle formed by flexible heavy paper or plastic strip that wraps around the cup to be connected together at its opposite ends. U.S. Pat. No. 5,147,067 issued to Effertz discloses a single layer elastic thermal insulator strip wrapped around a beverage can and secured by cooperative interlocking engagement members at the terminal ends of the strip. While these devices may be inexpensive and convenient, they do not provide the convenience desired for repetitive use.

Other prior art developments have sought to secure a beverage container in place while providing more durable handles. For instance, U.S. Pat. No. 4,874,109 issued to Cook discloses a split collar that fits over a beverage can and mounts a crank handle between its opposite ends for rotation to a securing position pressing frictionally against the side of the can. U.S. Pat. No. 4,993,675 issued to Walker discloses a can caddy having a bottom well with a vertical stem at one side mounting a hand grip configured with a forwardly projecting clasp at the top end. This one-piece cup caddy is designed to maintain its grip on a beverage can through downward pressure exerted by a resilient clip that secures the can in place in an indentation formed in a circular base. However, while these devices may be sufficient for supporting applications involving beverage cans, they are not well suited to applications incorporating beverage cups because the structural compositions of such cups do not have the inherent rigidity that is found in such beverage cans.

Some prior art devices have sought various ways to lend the sufficient rigidity to drinking cup applications that is required for user confidence and comfort. U.S. Pat. No. 4,715,633 issued to Brink et al. discloses an adjustable diameter coiled gripping member for surrounding a cup to be fixed at an adjusted diameter and held by a D-shaped handle. U.S. Pat. No. 5,655,805 issued to Shaddy discloses a cup holder formed by a wide ring of thermally insulative material and an annular band projecting radially inwardly and having an annular inward surface textured to frictionally engage the cup, the band being formed with a shoulder spaced below the upper edge of the ring. A vertically oriented elongated oval-shaped ring is mounted on the outer surface of the ring for supporting the ring and a cup held in the ring. However, while these devices may be of some utility, they are relatively bulky and the D and oval shaped handles do not afford good purchase for the user's fingers for positive support of the held cup.

Consequently, there exists a need for a cup holder that is designed to reliably and securely grasp a cup while providing a handle that may be complementally and comfortably received by the fingers of the user to hold the cup erect. It would also be beneficial for such a cup holder to incorporate structural features that permit the holder to grasp cups of varying dimensions and that prevent the movement of the cup and holder that may occur when the user does not grasp the handle tightly due to inability or fatigue.

SUMMARY OF THE INVENTION

The improved cup holder of the present invention is characterized by a circular band for nesting of a cup therein and a vertical stem secured to one side thereof and projecting downwardly below the band to form a vertically extending pad. A radially outwardly projecting hand grasp is formed with the stem. In one embodiment, the hand grasp may be in the form of a numeral 3 to be configured with vertically disposed finger-receiving ring shaped elements for receipt of the index and second finger of a user's hand.

Other objects and features of the invention will become apparent from consideration of the following description taken in conjunction with the accompanying drawing.

DETAILED DESCRIPTION OF THE PREFERRED EMBODIMENTS

Figure 1:
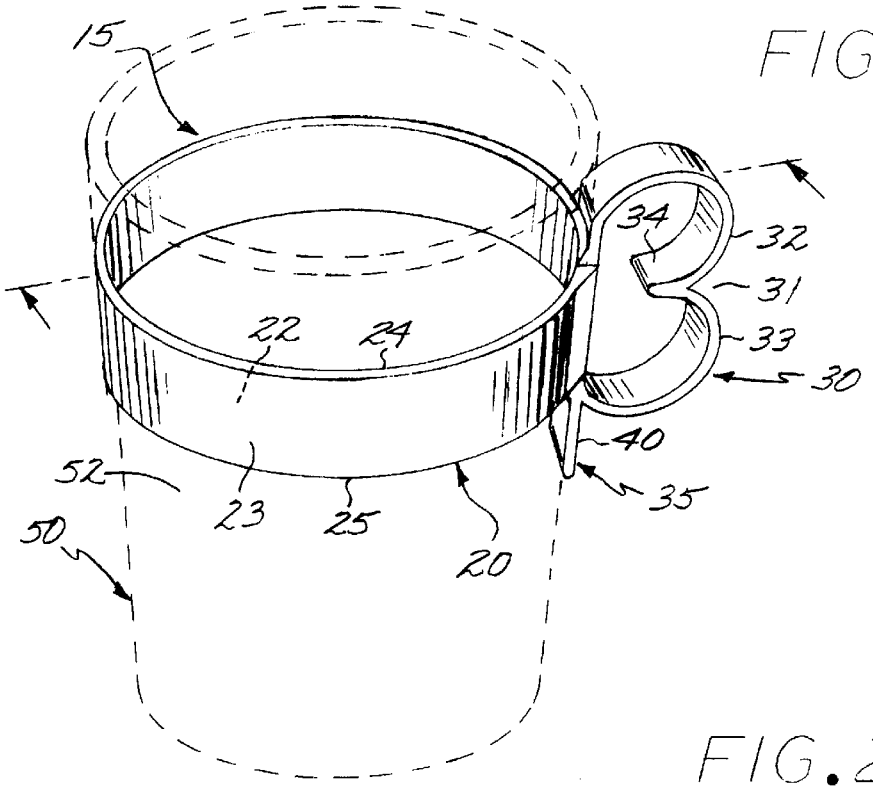
FIG. 1 is a perspective view showing the cup holder of the present invention with a cup shown in broken lines nested therein.
Figure 2:
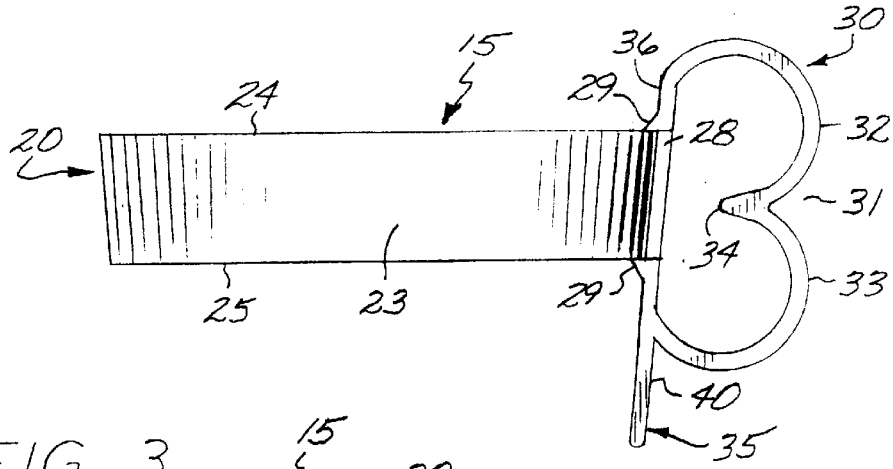
FIG. 2 is a left side view of the cup holder shown in FIG. 1.
Figure 3:
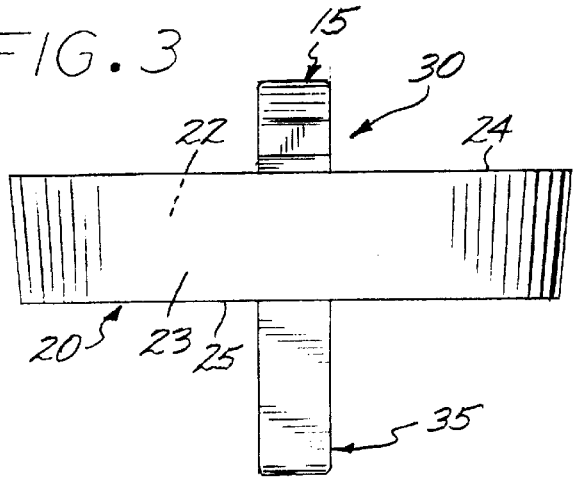
FIG. 3 is a front view of the cup holder shown in FIG. 1.

As shown in the drawings and for purposes of illustration, the cup holder of the present invention, generally designated 15 and shown in FIGS. 1—3, is embodied, generally, in a circular band 20 mounting the stem 35 portion of a laterally projecting handle 30. The stem 35 projects downwardly to form a pad 40, to press against the outer wall of a cup 50 held in the band 20 to support it erect.

The circular band 20 may be formed of any suitable material. However, in a preferred embodiment, it is constructed of a rigid molded plastic. As shown in FIGS. 2 and 3, the circular band 20 has an inner and outer surface 22 and 23, respectively, and an upper and lower edge 24 and 25, respectively. In one embodiment, the band is solid and is frusto conically shaped for complemental receipt of a frusto conically shaped cup. The external surface 23 of the band 20 conforms with the downward and inward angle of the inner surface 22 to maintain a consistent thickness to the band. This design is intended to mirror the general frusto conical shape of most common drinking cups.

The circular band 20 is of sufficient dimension to lend it rigidity and to accommodate variously dimensioned cups without being cumbersome or aesthetically unappealing. In a preferred embodiment, as shown in FIG. 1, the band is constructed with an inside diameter of 8 cm, a thickness of approximately 0.2 cm and a width of approximately 2 cm. These dimensions are suitable for holding most variations of common disposable drinking cups as shown in FIG. 1, wherein the cup 50 is nested within the inner diameter of the circular band 20 and secured by an interference fit that is formed between the external surface of the cup 52 and the inner surface 22 of the band. It is also contemplated that, as shown in FIG. 4., for cups 50 formed with radially outwardly projecting beads 54 around their upper periphery, the upwardly facing annular shoulder formed by the top edge of the band 24 will abut the bead to further cooperate in securing the cup 50 in such band.

The handle 30 includes a vertically projecting stem 35 joining the handle to the circular band 20 and a hand grasp 31 by which the user may grasp the handle to gain purchase of the cup holder 15. Referring now to FIG. 2, the stem 35 portion of the handle 30 is formed at the top and bottom edges of the band 24 and 25, respectively, with radially inwardly projecting braces 29 abutting the respective top and bottom edges. Such braces 29 serve to afford support for the relatively delicate plastic band 20 to thus prevent sagging thereof under the weight of liquid in the cup 50 and to minimize any tendency of the holder to fatigue and crack due to repetitive usage and flexing thereof at the interface between the stem 35 and band 20. Additionally, the circular band 20 is formed with longitudinally spaced apart, oppositely disposed brackets 28 abutting the respective vertical sides of the stem 35. As with the braces 29 formed integrally with the stem 35, such brackets 28 formed integrally with the band 20 serve to afford support to the stem 35 and to minimize any tendency of the holder to fatigue and crack due to flexing and use at the interface between the stem 35 and the band 20.

Figure 4:
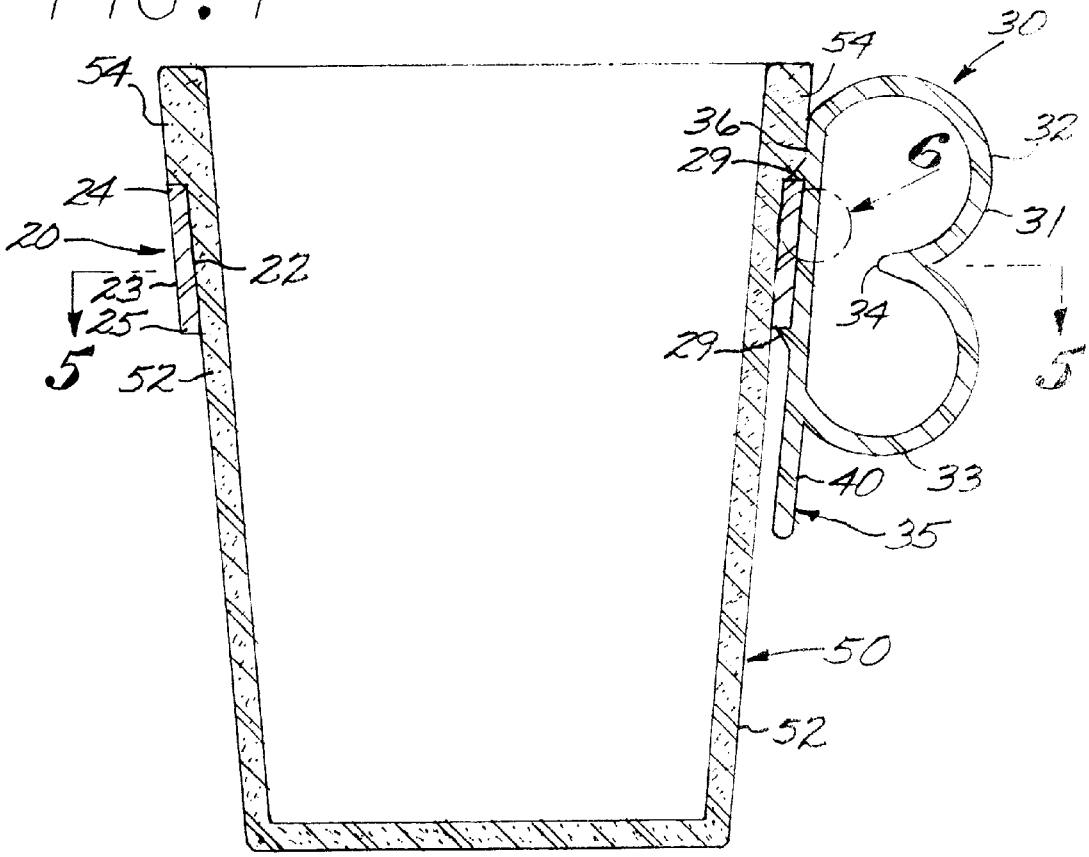
FIG. 4 is a vertical cross sectional view taken along line 4—4 of FIG. 1.
Figure 5:
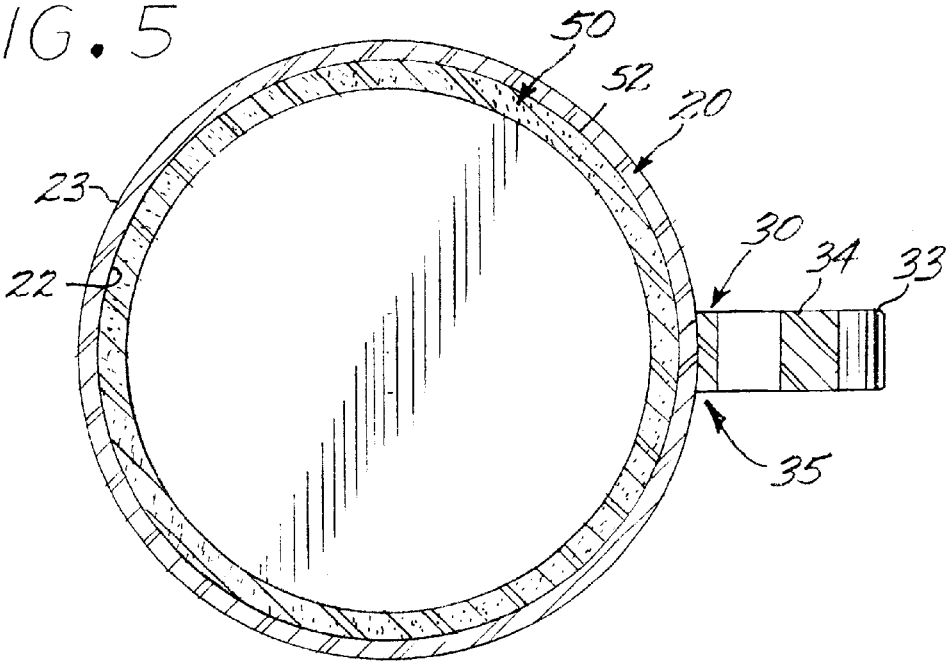
FIG. 5 is a horizontal cross sectional view taken along line 5—5 of FIG. 4.

The vertically projecting stem 35 is formed at one side of the band 20 and projects about 1 cm above the top edge thereof to form an upper pad 36 for engaging the bead 54 before the stem transitions into the upper portion of the handle 30 (FIG. 4). The stem 35 then projects along the outside of the band 20 and downwardly therebelow a total distance of approximately 3 cm, with approximately a 2 cm portion of this distance forming a pad 40 projecting downwardly from the point on the stem 35 at which the stem and the bottom portion of the handle 30 intersect. Such stem is relatively lightweight and is configured with a thickness of about 1 cm., an overall top to bottom length of about 6.5 cm and a width of about 2.8 cm.

Figure 6:
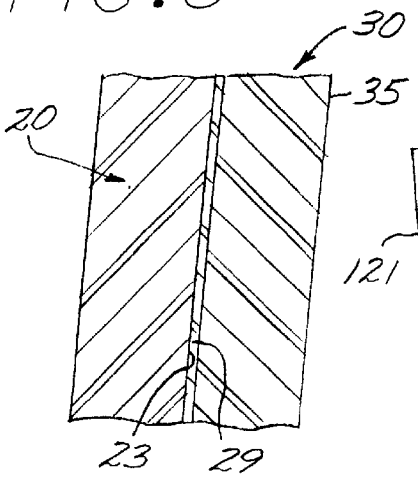
FIG. 6 is a detail view, in enlarged scale, taken from the circle designated 6 in FIG. 4.

In a preferred embodiment, the stem 35 of the handle 30 is bonded to the outer surface of the band 23 by means of a bonding layer 29 of suitable adhesive (FIG. 6). In other embodiments, however, the handle 30 may be formed integral with the band 20 as by injection molding. The handle 30 is formed with a hand grasp 31 comprising a pair of vertically spaced finger rings 32 and 33 for respective receipt of the first and second fingers of the user. As shown in FIGS. 1, 2 and 4, the hand grasp 31 is generally configured in the form of a numeral 3 with the upper and lower concave curvatures of the three extending slightly beyond the apex of the upper curvature and the nadir of the bottom curvature respectively.

The"3" shaped hand grasp 31 is formed integrally with the stem 35 and is to be configured with over and under finger ring elements 32 and 33, respectively, for conveniently and comfortably receiving the first and second fingers of a user's hand to afford favorable purchase thereof. In a preferred embodiment, the finger ring elements have a radius of about 1.25 cm. and a horizontal major interior dimension of about 2.5 cm. at the horizontal diameter thereof. Such hand grasp 31 is formed medially with a radially inwardly projecting horizontal divider 34 formed by the intermediate wall of the respective rings 32 and 33 to thus add to the stability of the grip by the user's fingers.

From the foregoing, it will be appreciated that the cup holder shown in FIGS. 1–6 is relatively inexpensive to manufacture and will require only a minimum quantity of fabrication material. The cup holder will typically be manufactured and packaged in bulk form for distribution to beverage retail outlets, such as take-out coffee shops and entertainment and sports facilities for use by the viewing public. The cup holder will typically be presented with the initial purchase of a beverage and is convenient and effective to use. The user will merely nest the cup 50 into the band 20 as shown in FIG. 1. Assuming the cup incorporates a lip bead 54, the bottom downwardly facing shoulder of such lip bead will nest on the upwardly facing upper edge 24 of the band 20. In any event, the band is sized to engage the peripheral wall 52 of the cup 15 near the upper edge thereof so as to restrict downward travel of the cup in such band and afford support therefor.

Once the cup has engaged at the appropriate level within the band 20, it will be appreciated that the stabilizer stem 35 will afford support against rocking of such cup within the band 20. To this end, when the user grasps the hand grasp 31 to lift the handle 30 and consequently lift the band 20, the cup will be raised therewith. Assuming the cup is nearly full of fluid, it will be appreciated that the handle 30 will serve to lift the band 20 and the fluid in the cup in cantilever fashion. The bottom of the cup will weigh downwardly and will typically tend to apply a torque to the band 20 as resisted by the components of the handle 30.

Referring to FIG. 4, it will be appreciated that the user's index and first finger will be received in the respective finger ring elements 32 and 33 in trigger-like fashion leaving the third finger free to press against the ring 33 and pad 40. If, for example, the user grasps the handle 30 with his or her right hand, the weight of the fluid will thus be resisted by the first finger (in most cases the index finger), received in the ring element 32, and the second finger (in most cases the middle finger), received in the ring element 33, drawing upwardly and to the right as viewed in FIG. 4. Typically, the user's thumb will press downwardly and inwardly on the top quadrant of the ring 32 thus pinching such ring between the thumb and the index finger. Simultaneously, the user's third finger (in most cases the ring finger) will rest against the pad 40, and will press downwardly and to the left, thus applying a clockwise torque to such handle 30. To the extent that there is any flexibility in the cup wall or the plastic strip forming the handle and stem, this will then tend to press the pad 40 to the left as viewed in FIG. 4, causing the inside wall of the pad 40 to engage the outer cup wall intermediate its height, thus affording support for the fluid contained therein. This construction thus affords a maximum amount of support and stability for the cup with a relatively lightweight thin walled cup holder.

This cup holder construction provides convenience in that, with the relatively inexpensive cost of the cup holder, a new cup holder may be provided free of charge by the beverage retail store. Further, because of the inexpensive construction, advertisers will be attracted to apply their advertising thereto and provide such cup holders free of charge for the advertising benefits. For example, it is contemplated that the handle 30 and band 20 may be constructed of varying colors or contain various advertising messages, depending on the commercial application and the desires of the advertiser.

Figure 7:
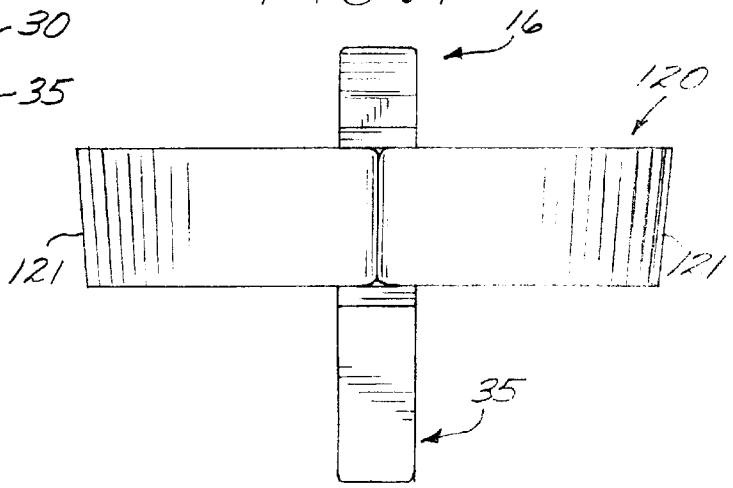
FIG. 7 is a front view of a second embodiment of the cup holder of the present invention in its relaxed position.
Figure 8:
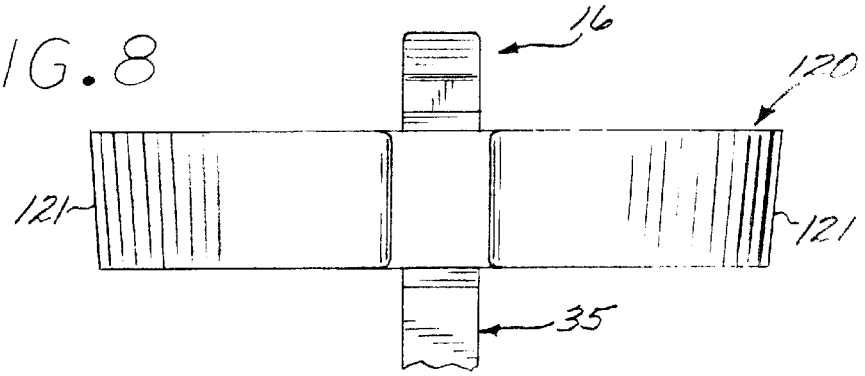
FIG. 8 is a front view of the cup holder shown in FIG. 7 expanded to a desired diameter.
Figure 9:
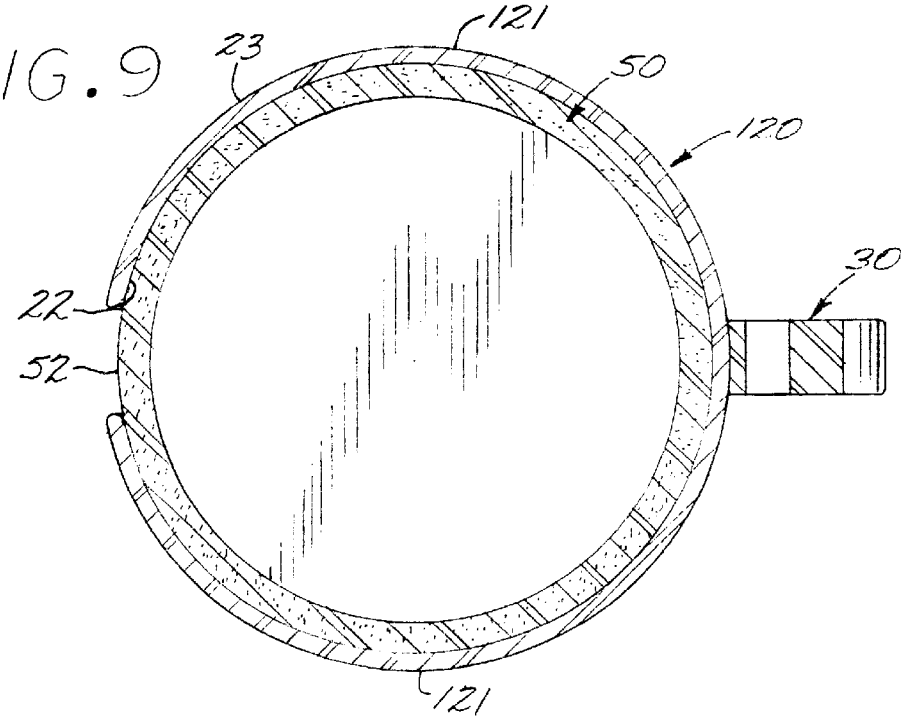
FIG. 9 is a horizontal cross sectional view of the cup holder shown in FIG. 8 with a cup nested therein.

A second embodiment of the cup holder of the present invention, generally designated 16 and shown in FIGS. 7 through 9, is similar to that shown in FIGS. 1 through 6 except that the band 120 is in the form of a split band to form a pair of opposed semi-cylindrical clamps 121 which might be flexed to different diameters to accommodate different diameter cups. It is also contemplated that such an adjustable split band 120 may be biased towards a closed position, and that the terminal edges formed at the split point will be aligned and contiguous in such a closed or relaxed position, as shown in FIG. 7. The construction of the stem 35 and overall handle 30 is similar to that for the cup holder shown in FIGS. 1 through 6.

From the foregoing, it will be appreciated that the cup holder of the present invention provides a reliable, convenient, affordable and effective means for confidently holding and picking up drinking cups when a user does not desire to directly engage the cup with his or her hand. The handle design emphasizes an efficient and comfortable interaction with both the left and right hand of the user, and its unique design lends additional support to the circular band in which the cup is nested. The band readily accommodates the most common dimensional variations found in drinking cups, and may be expandable if required to accommodate those that are not so common.

Various modifications and changes may be made with regard to the foregoing detailed description without departing from the spirit of the invention.

What is claimed is:

1. A cup holder for holding a cup formed with a bead around the upper periphery thereof and comprising:

a circular band for encircling said cup and formed on its top edge with an upwardly facing shoulder for abutting said bead;

a handle including a pair of vertically spaced finger rings for receiving the first and second fingers of a user; and a vertically extending stem interposed between said rings and said band and projecting downwardly to form a pad to be engaged by the third finger of said user.

2. The cup holder of claim 1 wherein:

said stem is configured such that said pad will, in use, engage the side wall of said cup.

3. The cup holder of claim 1 wherein:

said band and handle are formed integrally.

4. The cup holder of claim 1 wherein:

said band and handle are one piece.

5. The cup holder of claim 1 wherein:

said band is split on one side to form a pair of terminal edges and is adjustable to different diameter cups;

said band is biased towards a closed position wherein such terminal edges are aligned and contiguous.

6. The cup holder of claim 1 wherein:

said band is split on one side to form of a pair of oppositely disposed clamps adjustable to different diameter cups.

7. The cup holder of claim 1 wherein:

said band and handle are formed of molded plastic.

8. The cup holder of claim 1 that includes:

a brace projecting radially inwardly from said stem to engage said band.

9. The cup holder of claim 1 that includes:

a pair of braces projecting radially inwardly from said stem and engaging the upper and lower edges of said band.

10. A cup holder comprising:

a circular band; and a handle mounted on such circular band and formed with a vertically projecting stem projecting upwardly above said band and downwardly below said band, said handle further including finger rings for receiving the first and second fingers of a user.

11. The cup holder of claim 10 wherein:

said handle is formed with a divider forming the proximate sides of said rings and projecting inwardly toward said band to form a divider between said first and second fingers.

12. The cup holder of claim 10 wherein:

said divider terminates in a tip spaced from said stem to leave a clearance space therebetween.

13. A cup holder comprising:

a circular band; and a handle mounted on said band and including a vertically projecting stem, a pair of finger rings for receiving the first and second fingers of a user, said stem including means for engaging the third finger of the user.

14. The cup holder of claim 13 wherein:

said stem includes means for engaging the vertical wall of said cup intermediate the vertical height thereof.

15. The cup holder of claim 13 wherein:

said band and handle are one piece.

16. The cup holder of claim 13 wherein:

said band is split on one side to form of a pair of oppositely disposed clamps adjustable to different diameter cups.

17. A cup holder comprising:

a circular band; and a handle mounted on said band and including a vertically projecting stem and finger rings for receiving the first and second fingers of a user, said stem including pad means for engaging the third finger of the user.

18. A cup holder comprising:

a circular band for receipt of a cup;

a handle for receiving at least two fingers of a user's hand; and a vertically extending stem interposed between said handle and said band and projecting downwardly below said handle to form a pad to engage the side wall of a cup mounted in said band.

19. A cup holder including:

a plastic band 2 cm. wide for nesting therein of a cup; and a plastic handle formed integral with said band and being configured with a vertical stem projecting upwardly above said band and downwardly about 3 cm. below said band, said handle further being formed with a hand grasp portion configured in the form of a numeral 3 to form a pair of finger ring elements for receipt of the first and second fingers of a user's hand, said hand grasp being so configured and positioned relative to said stem such that, with the first and second fingers of the user's hand engaged in said ring elements, the third finger of such user can engage said pad.

20. A cup holder for holding a cup comprising:

a horizontally disposed frusto conical band for nesting therein of said cup;

a vertical stem mounted to one side of said cup and projecting upwardly above said band and at least 3 cm downwardly below said band for engaging the intermediate side wall of said cup;

a pair of braces projecting radially inwardly from said stem and engaging the respective upper and lower edges of said band;

a handle mounted on said stem and configured in the form of a numeral 3 to be configured with vertically disposed ring elements having a radius of 1.25 cm for receipt of the first and second fingers of the user, and configured medially with a radially inwardly projecting divider; and said stem being formed with a pad projecting downwardly below said handle to be engaged by the third finger of a hand of a user.

21. An improved cup holder comprising:

a band for encircling a cup;

a vertical stem mounted on one side of said band;

a hand grasp mounted on said stem and consisting of a pair of vertically spaced finger rings for receipt of the index and second fingers of a user and including a horizontally projecting divider intermediate said ring elements and projecting radially inwardly toward said band.

* * * * *